US010640255B1

(12) United States Patent
McClanahan et al.

(10) Patent No.: US 10,640,255 B1
(45) Date of Patent: May 5, 2020

(54) PACKAGING CONTAINER COMPRISING A PLURALITY OF COVERS

(71) Applicant: InsideOut Creations LLC, Greensboro, NC (US)

(72) Inventors: Michael Bradford McClanahan, Greensboro, NC (US); Michael Tucker McClanahan, Greensboro, NC (US)

(73) Assignee: InsideOut Creations, LLC, Greensboro, NC (US)

( * ) Notice: Subject to any disclaimer, the term of this patent is extended or adjusted under 35 U.S.C. 154(b) by 0 days.

(21) Appl. No.: 16/138,207

(22) Filed: Sep. 21, 2018

(51) Int. Cl.
*B65D 5/10* (2006.01)
*B65D 5/38* (2006.01)
*B65D 5/72* (2006.01)
*B65D 5/66* (2006.01)

(52) U.S. Cl.
CPC ..... *B65D 5/38* (2013.01); *B65D 5/66* (2013.01); *B65D 5/728* (2013.01)

(58) Field of Classification Search
CPC . B65D 5/38; B65D 5/66; B65D 5/728; B65D 2571/0058; B65D 5/725; B65D 5/4204; B65D 5/4237; B65D 5/48; B65D 81/3261
USPC ..... 229/125.12, 122, 121, 242, 120.03, 229/120.11, 120.14, 125.15, 131.1; 312/348.3; 221/91; 220/528, 506, 529; 222/129; 206/91, 561
See application file for complete search history.

(56) References Cited

U.S. PATENT DOCUMENTS 3,300,115 A * 1/1967 Schauer ..... B65D 71/36 221/305
4,944,405 A * 7/1990 Buford ..... B65D 5/48008 229/120.04
5,284,291 A * 2/1994 Sellors ..... B65D 5/48004 229/120.03
9,309,023 B2 * 4/2016 Hubbard, Jr. ..... B65D 5/2076
2012/0085767 A1 * 4/2012 Read ..... B65D 5/48038 220/523

* cited by examiner

*Primary Examiner* — Christopher R Demeree
(74) *Attorney, Agent, or Firm* — NK Patent Law

(57) ABSTRACT

The presently disclosed subject matter is directed to a packaging container that comprises an outer enclosure that include a plurality of covers that provide access to the enclosure interior. The interior comprises a plurality of compartments, each positioned adjacent to a corresponding cover in the outer enclosure. A single compartment can be accessed independently of the other compartments by opening the respective cover for that compartment. Thus, each inner compartment comprises an individual cover that can be opened on demand. One or more unique products can be housed within the interior of each inner compartment. In this way, the packaged products are kept isolated and protected until the user desires to access them.

8 Claims, 6 Drawing Sheets

PACKAGING CONTAINER COMPRISING A PLURALITY OF COVERS

TECHNICAL FIELD

The presently disclosed subject matter relates to a packaging container that comprises a plurality of covers that can be used to access one or more interior compartments, and to methods of making and using the disclosed packaging container.

BACKGROUND

Containers with partitions for separating multiple products within the container interior are well known. The dividers or partitions can minimize the potential for a product being damaged by other products shipped in the same container. Further, dividers can also support each product in a relatively safe position, providing cushioning during shipping and in the event the container is dropped. However, prior art containers that include dividers are typically sealed by a cover or lid that exposes the entire container interior when removed. As a result, the products housed within each partition are exposed, allowing them to absorb moisture, become damaged, and/or intermix between compartments. Further, in some embodiments, the user may desire to allow one or more compartments within the container interior to remain protected or isolated for a desired amount of time. Additionally, the container often allowed access to all or half of the dividers when a lid or cover was opened. For gift giving purposes, this had the effect of progressing the gifting exercise quickly instead of prolonging, and savoring, the exposure time for the giver and gift recipient. Therefore, it would be beneficial to provide a container that overcomes the shortcomings of the prior art.

SUMMARY

In some embodiments, the presently disclosed subject matter is directed to a packaging container comprising an outer enclosure that defines a plurality of covers that allow access to an interior thereof. The packaging container further comprises a plurality of compartments positioned within the interior of the outer enclosure, wherein each compartment defines at least one compartment opening that allows access to the interior. Each compartment opening is positioned adjacent to a respective cover in the outer enclosure when the compartment is received within the outer enclosure. Each compartment is configured to receive a gift or item or merchandise. Each compartment is further configured to be accessed independently of the other compartments by opening of the respective cover for that compartment. At least one of the compartments defines a size that is different from a size of another one of the compartments.

In some embodiments, each of the plurality of covers comprises a flap of material defined from the outer enclosure.

In some embodiments, each of the plurality of covers is defined by a perforated cut-out.

In some embodiments, each cover corresponds to a compartment opening.

In some embodiments, the outer container, plurality of compartments, or all of the foregoing are rectangular in shape.

In some embodiments, the plurality of compartments are configured as an insert that is sized and shaped to fit within the interior of the outer container. In some embodiments, the insert defines a plurality of recesses corresponding to the compartments.

In some embodiments, the outer container and the plurality of compartments are integrally engaged to each other.

In some embodiments, the presently disclosed subject matter is directed to a method of packaging one or more gifts, items, or merchandise within each compartment of a packaging container. Particularly, the method comprises inserting one or more gift or items or merchandise into a compartment of an outer enclosure of the packaging container, wherein each compartment defines at least one compartment opening that allows access to an interior of the outer enclosure. The process is repeated for a desired number of gift or items or merchandise. The compartments are positioned within an interior of the outer enclosure, wherein the outer enclosure comprises a plurality of covers, each cover allowing access to a corresponding compartment configured on the interior of the outer enclosure. Each compartment opening is positioned adjacent to a respective cover in the outer enclosure when the compartment is received within the outer enclosure. Each compartment is configured to receive a gift or item or merchandise. Each compartment is configured to be accessed independently of the other compartments by opening of the respective cover for that compartment. At least one of the compartments defines a size that is different from a size of another one of the compartments.

In some embodiments, the presently disclosed subject matter is directed to a method of independently removing one or more products from a compartment of a packaging container. The method comprises opening a cover of an outer enclosure of the packaging container, wherein the cover allows access to a plurality of compartments configured on an interior of the outer enclosure. Each compartment defines at least one compartment opening that allows access to the interior of the outer enclosure. The method includes accessing the interior of a desired compartment through the corresponding compartment opening, and removing one or more gifts or items or merchandise from the interior of a desired compartment. Each compartment is configured to be accessed independently of the other compartments by opening of the respective cover for that compartment. At least one of the compartments defines a size that is different from a size of another one of the compartments.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a container" can include a plurality of such containers, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1A:
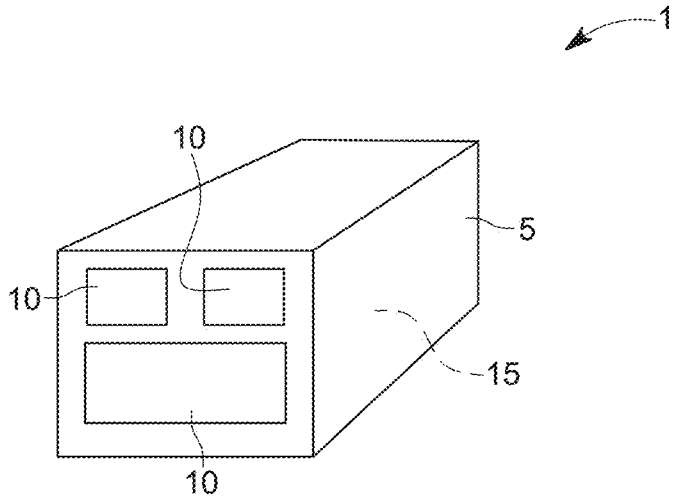
FIG. 1*a* is a perspective view of a packaging container in accordance with some embodiments of the presently disclosed subject matter.
Figure 1B:
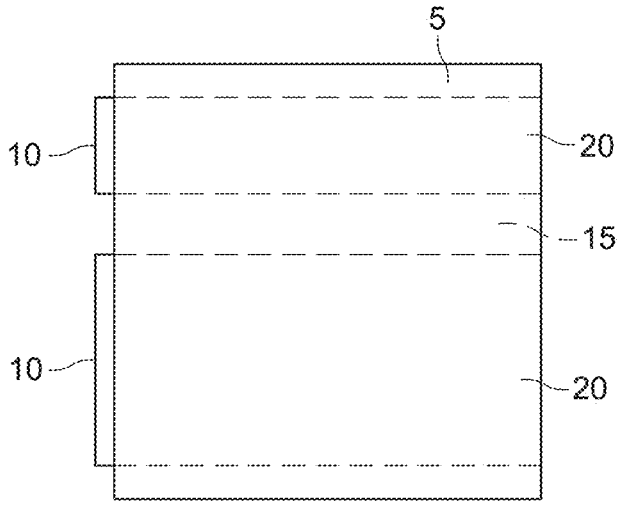
FIG. 1*b* is a side plan view of a packaging container in accordance with some embodiments of the presently disclosed subject matter.

FIG. 1*a* illustrates one embodiment of packaging container 1 in accordance with some embodiments of the presently disclosed subject matter. Particularly, the packaging container comprises outer enclosure 5 comprising a plurality of covers 10 that provide access to enclosure interior 15. The term "outer enclosure" as used herein refers to any container capable of holding or retaining another object. The term "cover" as used herein refers to a component of the outer enclosure that allows a user to access a part, portion, or the entirety of the interior of the enclosure. As illustrated in FIG. 1*b*, interior 15 of the outer enclosure comprises a plurality of compartments 20, each positioned adjacent to a corresponding cover 10 in the outer enclosure. A single compartment can be accessed independently of the other compartments by opening the respective cover for that compartment. Thus, each inner compartment 10 comprises an individual cover that can be opened on demand. One or more products are housed within the interior of each inner compartment 10. In this way, the packaged products are kept isolated and protected until the user desires to access them.

Figure 2A:
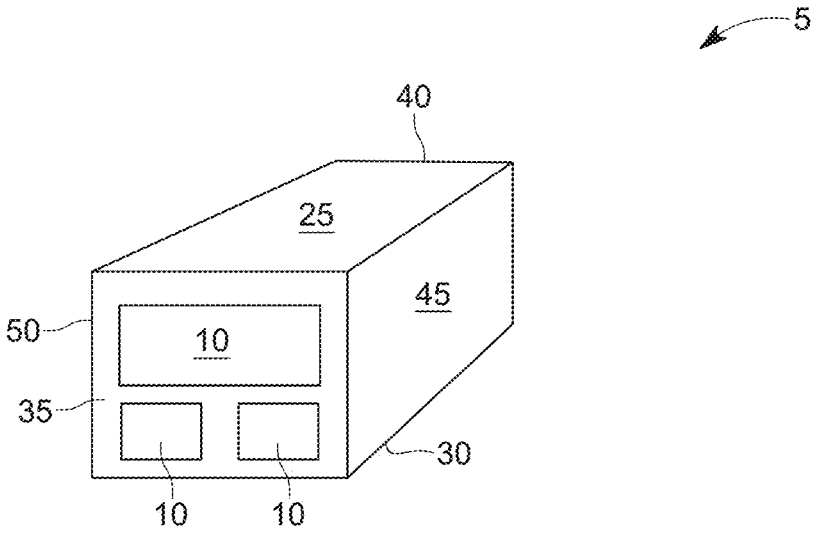
FIGS. 2*a* and 2*b* are perspective views of outer enclosures in accordance with some embodiments of the presently disclosed subject matter.

FIG. 2*a* illustrates one embodiment of outer enclosure 5 constructed in a rectangular configuration. As shown, the outer enclosure can include top face 25 and opposed bottom face 30, front face 35 and opposed rear face 40, and opposed side faces 45, 50. The faces of the outer enclosure are continuous to form a closed container. In some embodiments, the faces of the outer container are hinged together by folding a particular face relative to an adjacent face, as would be known in the art. However, the presently disclosed outer enclosure is not limited and can be formed by joining various faces together using any known method, such as through the use of adhesives, clips, heat sealing, and the like.

It should be appreciated that the shape of the outer enclosure is not limited. For example, in some embodiments, the outer enclosure can be configured in a square, hexagonal, pentagonal, abstract, etc. shape. In some embodiments, the outer enclosure can include at least one flat or horizontal face to allow the container to rest on a level surface, such as the ground.

The size of the outer enclosure is not limited, and can be selected based on the products to be packaged and/or the size of inner compartments 20. For example, in some embodiments, the outer enclosure can have length, width, and/or height of about 5-50 inches. However, the size of the outer enclosure is not limited and can be configured with a length, width, and/or height smaller or larger than the range given above.

Outer enclosure 5 can be constructed from any desired material, such as (but not limited to) paper, paperboard, woven material, foil, fabric, foam, cardboard, polymeric material, and combinations thereof.

Figure 2B:
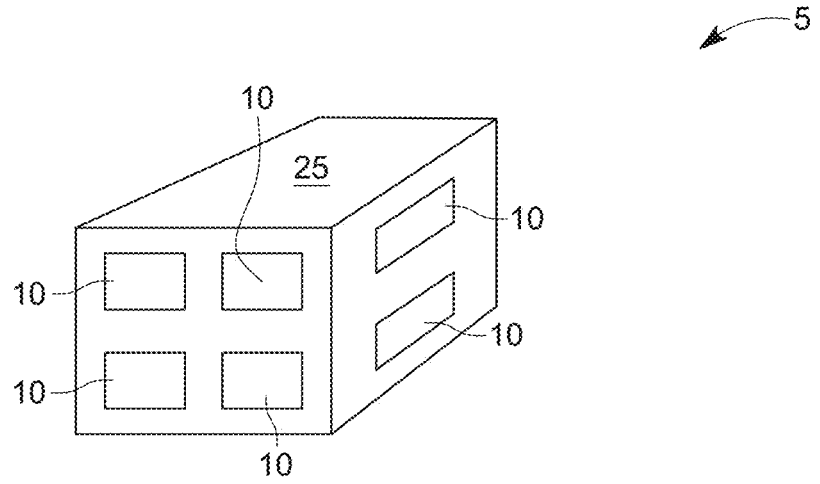
Figure 2C:
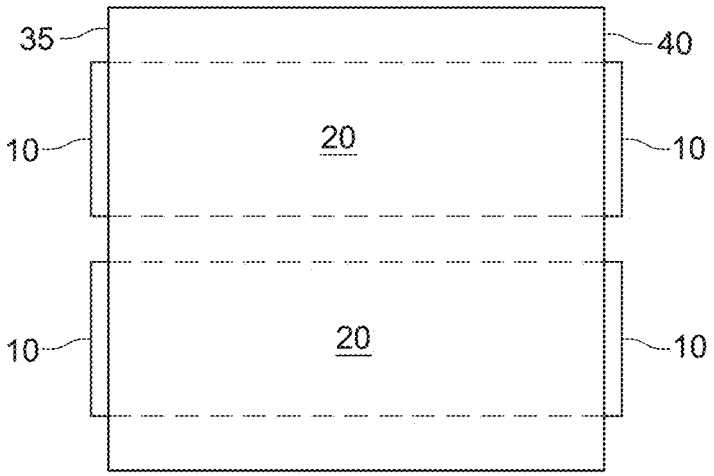
FIGS. 2*c* and 2*d* are side plan views of outer enclosures in accordance with some embodiments of the presently disclosed subject matter.
Figure 2D:
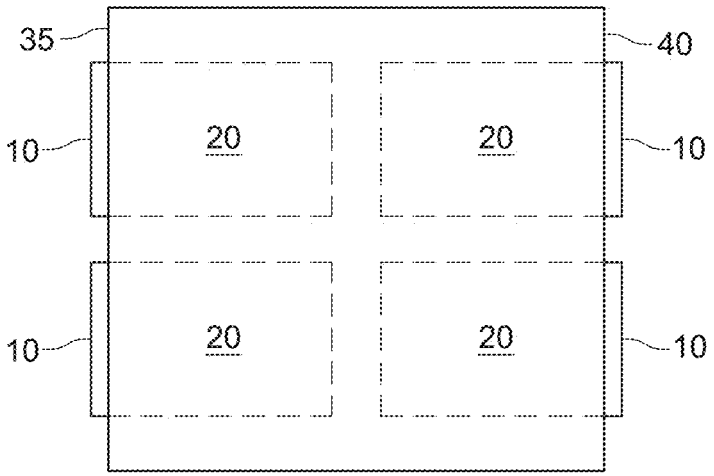

As shown in FIG. 2*a*, at least one face of outer enclosure 5 includes a plurality of covers 10 that allow a user to access a corresponding compartment positioned on interior 15. Each cover can be formed through one of the faces of the outer enclosure into an adjacent internal compartment 20. Access to each internal compartment is therefore provided through one or more covers 10. In some embodiments, the plurality of covers are positioned on a single face of the outer container, as shown in FIG. 2*a*. However, the outer container can be configured to include covers positioned on more than one face, as illustrated in FIG. 2*b*. In these embodiments, the user can access a single inner compartment from more than one cover (e.g., covers positioned on the front face and the rear face), as illustrated in FIG. 2*c*. Alternatively or in addition, a cover can access a separate compartment, as shown in FIG. 2*d*.

Figure 3A:
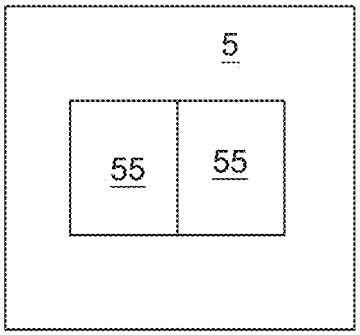
FIGS. 3*a*-3*d* are top plan views of inner compartment covers in accordance with some embodiments of the presently disclosed subject matter.

Covers 10 can include any opening known or used in the art. The term "opening" refers to one or more holes, gaps, cuts, slits, and the like. Thus, each cover can include a partial or complete opening of the outer enclosure. As shown in FIG. 3*a*, suitable covers can include (but are not limited to) one or more flaps 55 that can be removed, separated, repositioned, etc. to provide access to an inner compartment.

Flaps 55 can be formed directly on one or more faces of the outer enclosure using known methods, such as a die cut head, laser, knife, scissors, etc. In some embodiments, flaps 55 can be constructed separately and attached over an opening in a face of the outer enclosure, such as through heat sealing, adhesive, and the like.

Figure 3B:
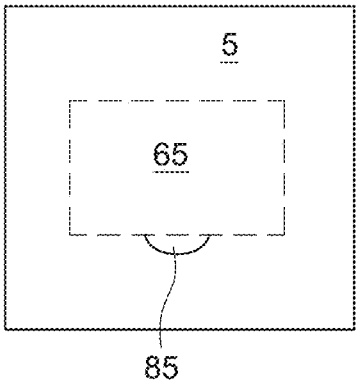

In some embodiments, cover 10 can be configured as one or more perforated areas 65 that can be fully removed (e.g., creating a hole) or partially removed (e.g., creating a flap) to provide access to compartment 20, as shown in FIG. 3*b*. In some embodiments, the perforated area can include through hole 85 to allow a user to easily access the perforations. Perforations 65 can be constructed using any known mechanism, including (but not limited to) laser cutting. Upon the application of pressure, the perforated areas fully or partially open, providing access to the adjacent inner compartment.

Figure 3C:
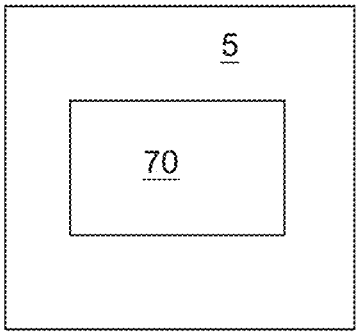

As illustrated in FIG. 3*c*, cover 10 can be configured as one or move cover panels 70. The panel can be lifted or removed to provide access to a corresponding inner compartment. Panels 70 can be formed using any known mechanism, such as a cutting utensil (e.g., blade, knife, or scissors). In some embodiments, cover panel 70 can be constructed separately and attached over an opening in a face of the outer enclosure, such as through heat sealing, adhesive, and the like.

Figure 3D:
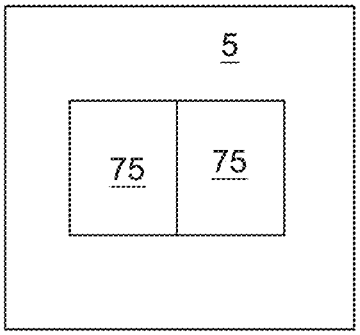

In some embodiment, the cover can be configured as one or more hinged or folding doors 75, as shown in FIG. 3*d*. Particularly, the doors can fully or partially open to allow a user to access an adjacent interior compartment. Doors 75 can be formed using any conventional method known or used in the art.

In some embodiments, cover 10 is resealable to allow it to be opened and closed multiple times. To this end, the cover can include an adhesive, hook-and-loop closure, clips, etc. to re-close the compartment.

Each cover of the outer enclosure can be of the same type (e.g., flaps). However, in some embodiments, at least one cover 10 can be of a different type compared to another (e.g., a flap and an area of perforations).

The covers can be constructed directly within outer enclosure 5. For example, when configured as an area of perforations, the perforations can be positioned directly in a desired face of the outer enclosure. However, the presently disclosed subject matter also includes embodiments wherein the cover is affixed or attached to a face of the outer enclosure. Thus, as set forth above, a flap can be adhered to cover a hole positioned in one face of the outer enclosure. The flap can be attached using any conventional methods, such as through the use of heat sealing, adhesive, and the like.

Covers 10 can be configured in any desired shape, such as square, rectangular, oval, circular, triangular, abstract, and the like. In some embodiments, each cover can have the same or similar cross-sectional shape and/or size as the corresponding compartment. Further, the covers can be configured in any desired size to allow the user to access the corresponding compartment.

In some embodiments, each cover can be configured in about the same shape and/or about the same size. However, the presently disclosed subject matter also includes embodiments wherein at least one cover 10 has a different size and/or shape compared to another cover.

Outer enclosure 5 can be configured with any desired number of covers. For example, in some embodiments, the outer enclosure can include 2 to 10 covers. However, it should be appreciated that the outer enclosure is not limited.

Figure 4A:
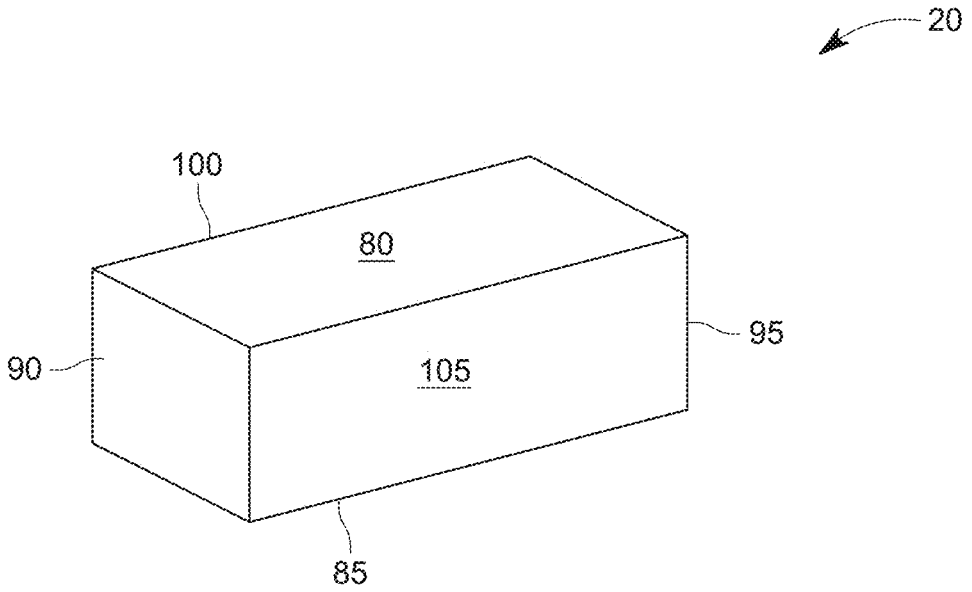
FIG. 4*a* is a perspective view of an outer enclosure compartment in accordance with some embodiments of the presently disclosed subject matter.
Figure 4B:
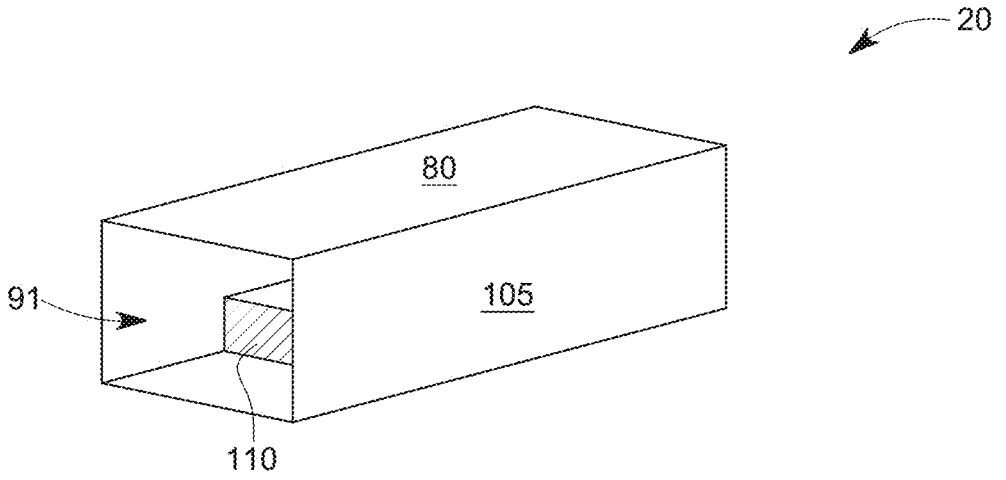
FIG. 4*b* is a perspective view of an outer enclosure compartment housing a product in accordance with some embodiments of the presently disclosed subject matter.

As set forth above, interior 15 of the outer enclosure comprises one or more compartments 20. FIG. 4*a* illustrates one embodiment of compartment 20 that can be positioned within the interior of outer enclosure 5. Particularly, compartment 20 can be configured as a stand-alone object that includes opposed top and bottom faces 80, 85, opposed front and rear faces 90, 95, and opposed side faces 100, 105. At least one of the faces of the compartment comprises opening 91 to allow one or more products 110 to be housed therein, as shown in FIG. 4*b*. In some embodiments, at least one face of compartment 20 can be configured as an open face (e.g., without a bottom). In some embodiments, one or more compartments 20 can be bonded together and/or to the interior surface of the outer enclosure using standard techniques (e.g., adhesive, heat sealing, and the like). The compartments can be configured to fit closely within the interior of the outer enclosure. Products 110 may be a gift or similar item.

Figure 5A:
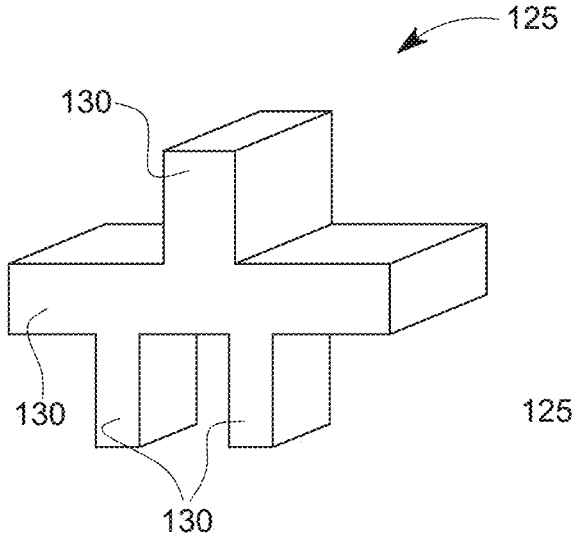
FIG. 5*a* is a perspective view of an enclosure insert that can be used with an outer enclosure in accordance with some embodiments of the presently disclosed subject matter.
Figure 5B:
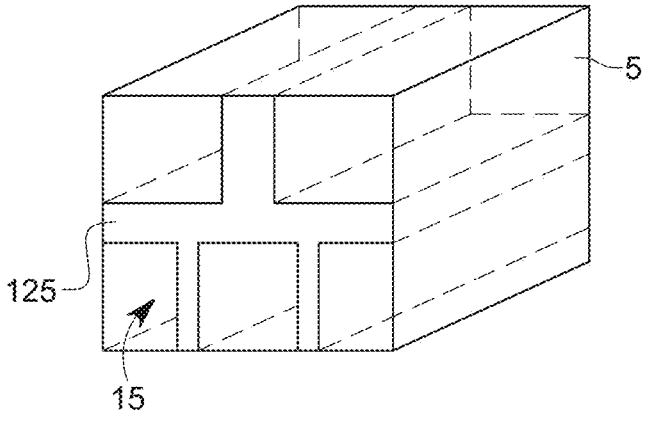
FIG. 5*b* is a perspective view of an enclosure insert configured within the interior of an outer enclosure in accordance with some embodiments of the presently disclosed subject matter.

In some embodiments, compartments 20 can be configured from one or more inserts 125 positioned within enclosure interior 15, as illustrated in FIG. 5*a*. The insert includes one or more arms 130 that contact and cooperate with the interior of the outer enclosure to form a plurality of compartments 20 for housing products 110. The insert is therefore configured to fit closely within the interior of the outer enclosure (e.g., the total width and length are about the same as those of interior 15). In some embodiments, the insert is held in place through adhesive, mechanical closures, or any other known mechanism.

Figure 5C:
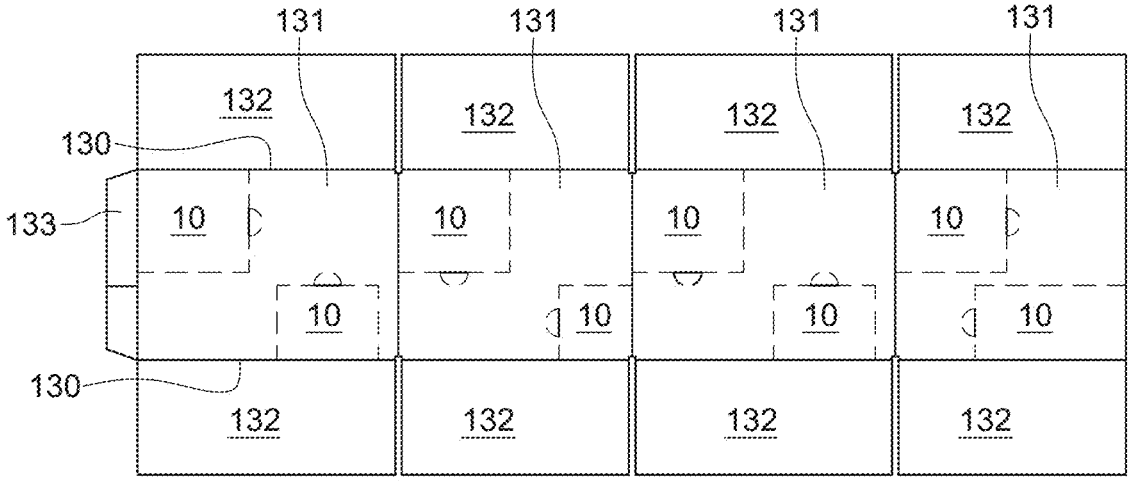
FIG. 5*c* is a top plan view of an outer enclosure blank in accordance with some embodiments of the presently disclosed subject matter.

In some embodiments, compartments 20 can be formed as part of an outer enclosure blank. The blank can be readily erected from a flat condition to form a rectangular outer enclosure with a plurality of interior compartments without the need for adhesively joining the panels. One example of a suitable blank is illustrated in FIG. 5*c*. As shown, the blank has rectangular or square main panel portions 131. The disclosed blank can be folded along one or more lines 130 and closed into the outer enclosure structure by applying glue and/or folding. In some embodiments, the fold lines can be scored to provide for easy bending of the panels. The blank can include one or more side flaps 132 and/or end flaps 133 that can be used to fold and/or secure the outer enclosure in the folded position. Covers 10 can also be configured in the main panels, as shown.

Any method can be used to deposit product 110 within a desired compartment of the outer enclosure. In some embodiments, a selected cover 10 can be opened to provide access to one or more compartments 20 configured within the interior of outer enclosure 5. For example, when cover 20 is configured as hinged doors 75, the user maneuvers the doors to an "open" position, providing access to the corresponding compartment. Product 110 can then be placed within the compartment. Similarly, when cover 20 is configured as one or more flaps 55, the user can position the flaps to the side or away from the compartment opening. After the cover has been opened, one or more products 110 can be inserted into compartment 20. The cover can then be re-positioned over the compartment to arrive at the embodiment of FIG. 1*a*.

Alternatively, product 110 can be loaded into one or more desired compartments 20 using standard methods (e.g., by hand, mechanically). After the products have been positioned within the compartments, the compartments can be loaded into interior 15 of the outer enclosure through an open face of the enclosure prior to folding the enclosure to the closed position. The face can then be sealed, creating a closed outer enclosure with one or more products housed within one or more compartments therein. In some embodiments, covers 10 (e.g., flaps 55) can be positioned over the compartments. In this way, each compartment opening is positioned adjacent to a respective cover 10.

Product 110 can include any desired product. For example, in some embodiments, suitable products can include (but are not limited to) any of the wide variety of known gifts, merchandise, etc.

As set forth herein above, each compartment is configured to be accessed independently of the other compartments. Particularly, a user can open cover 10 of a desired compartment 20. The user can then access product 110 housed within the compartment, while the remaining compartments remain closed. The remaining compartments can be opened (and products housed within the compartment interiors accessed) at any desired time. In some embodiments, outer enclosure 5 can be reused by depositing new products 110 within one or more compartments 20.

Advantageously, the disclosed packaging container allows a user to access a single interior compartment without opening adjacent compartments. In this way, products housed within the unopened compartments remain protected until the user desires to access them.

What is claimed:

1. A packaging container comprising:

an outer enclosure that defines a plurality of covers that allow access to an interior thereof;

a plurality of compartments positioned within the interior of the outer enclosure, wherein each compartment defines at least one compartment opening that allows access to the interior;

wherein each compartment opening is positioned adjacent to a respective cover in the outer enclosure when the compartment is received within the outer enclosure, wherein each compartment is configured to receive a gift or item or merchandise;

wherein each compartment is configured to be accessed independently of the other compartments by opening of the respective cover for that compartment; and wherein at least one of the compartments defines a size that is different from a size of another one of the compartments, wherein at least one side of the outer enclosure includes one of the plurality of compartments and another side of the outer enclosure extending perpendicular relative to the at least one side includes another of the plurality of compartments, each of the compartments having a respective cover so that a user can access the compartment from the at least one side of the outer enclosure and the another side of the outer enclosure such that the respective compartments extend perpendicular to one another.

2. The packaging container of claim 1, wherein each of the plurality of covers comprises a flap of material defined from the outer enclosure.

3. The packaging container of claim 1, wherein each of the plurality of covers is defined by a perforated cut-out.

4. The packaging container of claim 1, wherein each cover corresponds to a compartment opening.

5. The packaging container of claim 1, wherein the outer container, plurality of compartments, or all of the foregoing are rectangular in shape.

6. The packaging container of claim 1, wherein the plurality of compartments are configured as an insert that is sized and shaped to fit within the interior of the outer container.

7. The packaging container of claim 6, wherein the insert defines a plurality of recesses corresponding to the compartments.

8. The packaging container of claim 1, wherein the outer container and the plurality of compartments are integrally engaged to each other.

* * * * *